US006804926B1

(12) United States Patent
Eisermann

(10) Patent No.: US 6,804,926 B1
(45) **Date of Patent: *Oct. 19, 2004**

(54) METHOD FOR LAYING AND INTERLOCKING PANELS

(75) Inventor: Ralf Eisermann, Cochem (DE)

(73) Assignee: Akzenta Paneele + Profile GmbH, Kaisersesch (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/609,251

(22) Filed: Jun. 30, 2000

Related U.S. Application Data

(63) Continuation of application No. PCT/DE00/00870, filed on Mar. 22, 2000.

(30) Foreign Application Priority Data

Jul. 2, 1999 (DE) ..... 299 11 462 U

(51) Int. Cl.[7] ..... E04F 13/08; E04B 2/00

(52) U.S. Cl. ..... 52/592.1; 52/592.4; 52/474.1

(58) Field of Search ..... 52/592.1, 592.4, 52/747.1, 70, 71, 539, 591.1; 428/58, 60, 192

(56) References Cited

U.S. PATENT DOCUMENTS

| | | | | |
|---|---|---|---|---|
| 890,436 A | * | 6/1908 | Momberg | 52/592.1 X |
| 1,776,188 A | | 9/1930 | Langbaum | |
| 1,854,396 A | | 4/1932 | Davis | |
| 2,138,085 A | | 11/1938 | Birtles | |
| 2,142,305 A | | 1/1939 | Davis | |
| 2,381,469 A | | 8/1945 | Sweet | |
| 2,430,200 A | | 11/1947 | Wilson | |
| 2,740,167 A | | 4/1956 | Rowley | |
| 3,040,388 A | | 6/1962 | Conn | |
| 3,172,508 A | | 3/1965 | Doering et al. | |

(List continued on next page.)

FOREIGN PATENT DOCUMENTS

| | | |
|---|---|---|
| BE | 417526 | 10/1936 |
| BE | 418853 | 1/1937 |
| BE | 765817 | 9/1971 |
| CA | 2150384 | 11/1924 |
| CA | 991373 B | 6/1976 |

(List continued on next page.)

OTHER PUBLICATIONS

Webster's II New Riverside University Dictionary, 1984, 'scarf', pp 1042–1043, Houghton Mifflin Company, Boston, MA.

*Primary Examiner*—Robert Canfield
(74) *Attorney, Agent, or Firm*—Whiteford, Taylor & Preston LLP; Gregory M. Stone; Jeffrey C. Maynard

(57) ABSTRACT

Rectangular floor panels, a fastening system for joining the panels, and a method for laying and interlocking the panels are disclosed. The panels are provided complementary, form-fitting retaining profiles extending over the length of the sides. The complementary edges of the panels allow two adjacent panels to be positively joined such that displacement of the panels away from one another is prevented, while enabling articulation of the panels with respect to one another at the joint location. The method of installation provides for installing a new panel to a first row and a panel in a second row by first joining the new panel to the panel of the second row at its short side, followed by pivoting the new panel upwards out of the plane of the laid panels along its long side, along with at least the adjacent end of the first panel in the second row, into an inclined position, and sliding the new panel into the retaining profile of the panels in the first row. The new panel and the raised end of the panel in the second row are then pivoted down into the plane of the laid panels. Laying of panels continues according to this process until the complete floor assembly has been laid.

49 Claims, 7 Drawing Sheets

U.S. PATENT DOCUMENTS

Figure 1:
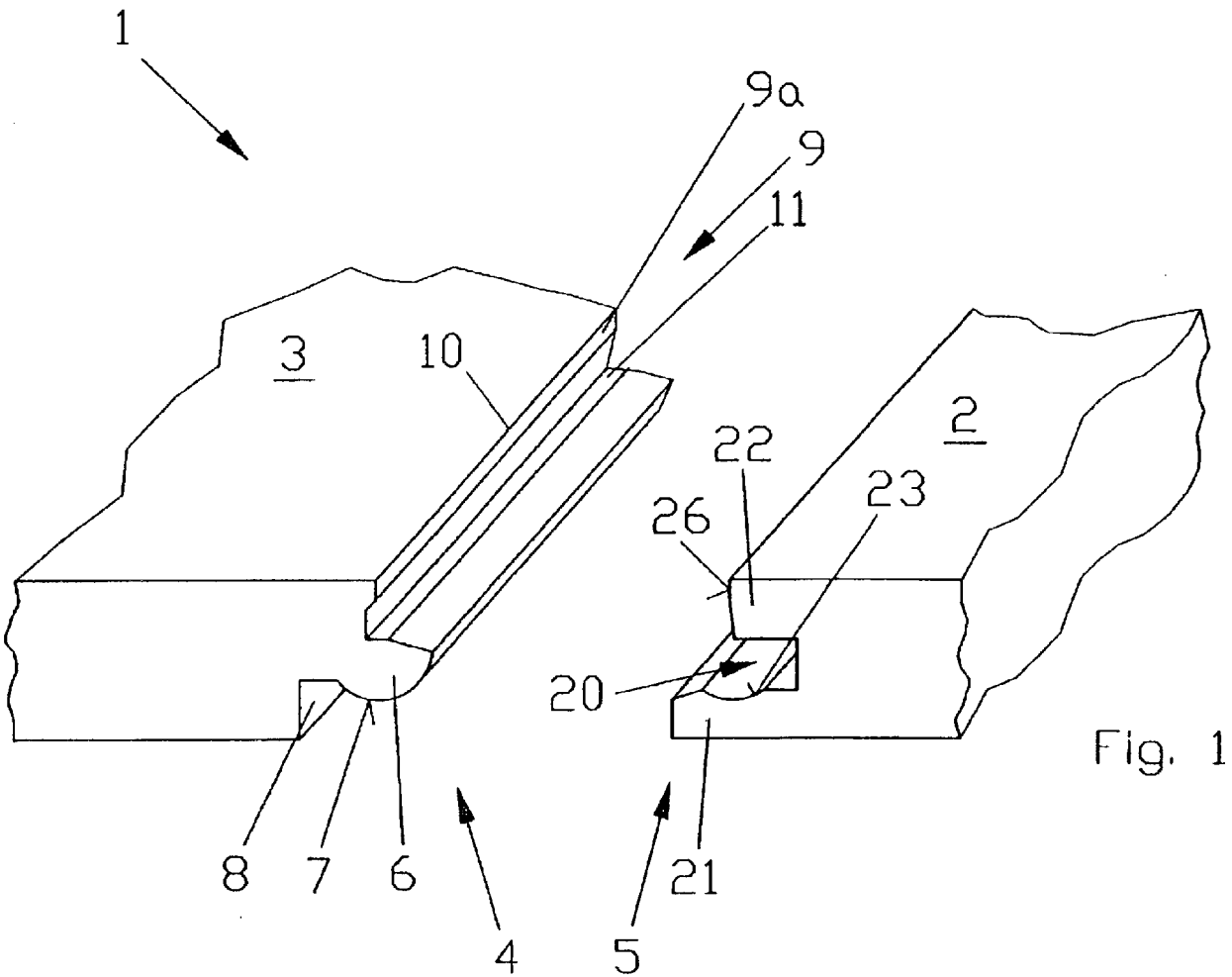

| | | | | | |
|---|---|---|---|---|---|
| 3,175,476 | A | | 3/1965 | Franks | |
| 3,192,574 | A | | 7/1965 | Jaffe et al. | |
| 3,200,553 | A | * | 8/1965 | Frashour et al. | 52/592.4 |
| 3,310,919 | A | | 3/1967 | Bue et al. | |
| 3,347,048 | A | | 10/1967 | Brown | |
| 3,526,420 | A | | 9/1970 | Brancaleone | |
| 3,579,941 | A | * | 5/1971 | Tibbals | 52/592.4 X |
| 3,657,852 | A | | 4/1972 | Worthington et al. | |
| 3,673,751 | A | | 7/1972 | Boassy et al. | |
| 3,902,291 | A | | 9/1975 | Zucht | |
| 3,988,187 | A | | 10/1976 | Witt et al. | |
| 4,094,090 | A | | 6/1978 | Walmer | |
| 4,416,097 | A | | 11/1983 | Weir | |
| 4,426,820 | A | | 1/1984 | Terbrack | 52/594 |
| 4,599,841 | A | | 7/1986 | Haid | |
| 4,741,136 | A | | 5/1988 | Thompson | |
| 4,807,416 | A | * | 2/1989 | Parasin | 52/595 |
| 4,819,532 | A | | 4/1989 | Benuzzi et al. | |
| 4,819,932 | A | | 4/1989 | Trotter, Jr. | |
| 5,086,599 | A | | 2/1992 | Meyerson | |
| 5,165,816 | A | * | 11/1992 | Parasin | 52/592.4 X |
| 5,283,102 | A | | 2/1994 | Sweet et al. | |
| 5,295,341 | A | | 3/1994 | Kajiwara | |
| 5,363,616 | A | * | 11/1994 | Hernandez | 52/281 |
| 5,618,602 | A | * | 4/1997 | Nelson | 52/592.1 X |
| 5,630,304 | A | | 5/1997 | Austin | |
| 5,706,621 | A | | 1/1998 | Pervan | 52/405.1 |
| 5,797,237 | A | | 8/1998 | Finkell, Jr. | |
| 5,860,267 | A | | 1/1999 | Pervan | 52/748.1 |
| 6,006,486 | A | * | 12/1999 | Moriau et al. | 52/589.1 |
| 6,023,907 | A | | 2/2000 | Pervan | 52/748.1 |
| 6,029,416 | A | | 2/2000 | Andersson | |
| 6,094,882 | A | | 8/2000 | Pervan | |
| 6,098,365 | A | * | 8/2000 | Martin et al. | 52/592.1 X |
| 6,122,879 | A | | 9/2000 | Montes | |
| 6,182,410 | B1 | | 2/2001 | Pervan | |
| 6,209,278 | B1 | * | 4/2001 | Tychsen | 52/592.1 X |
| 6,216,409 | B1 | * | 4/2001 | Roy et al. | 52/592.1 X |
| 6,324,809 | B1 | * | 12/2001 | Nelson | 52/592.2 |
| 6,397,548 | B1 | * | 6/2002 | Martin et al. | 52/592.4 |
| 6,505,452 | B1 | * | 1/2003 | Hannig et al. | 52/582.1 |
| 6,513,862 | B2 | * | 2/2003 | Dodson et al. | 296/155 |
| 6,546,691 | B2 | * | 4/2003 | Leopolder | 52/747.1 |
| 2002/0112433 | A1 | * | 8/2002 | Pervan | 52/592.1 |
| 2002/0170258 | A1 | * | 11/2002 | Schwitte et al. | 52/592.1 |
| 2003/0024200 | A1 | * | 2/2003 | Moriau et al. | 52/592.1 |
| 2003/0024201 | A1 | * | 2/2003 | Moriau et al. | 52/592.1 |
| 2003/0029115 | A1 | * | 2/2003 | Moriau et al. | 52/592.1 |
| 2003/0029116 | A1 | * | 2/2003 | Moriau et al. | 52/592.1 |

FOREIGN PATENT DOCUMENTS

| | | | | | |
|---|---|---|---|---|---|
| CH | 200949 | | | 11/1938 | |
| CH | 562377 | | | 5/1975 | |
| DE | 1 963 128 | | | 6/1967 | |
| DE | DT 2 159 042 | | | 6/1973 | |
| DE | 7402354 | | | 5/1974 | |
| DE | DT 25 02 992 | A1 | | 7/1976 | |
| DE | DT 26 16 077 | A1 | | 10/1977 | |
| DE | 29 17 025 | A1 | | 11/1980 | |
| DE | 7928703 | | | 5/1981 | |
| DE | 30 41 781 | A1 | | 6/1982 | |
| DE | 31 17 605 | A1 | | 11/1982 | |
| DE | 33 43 601 | A1 | | 6/1985 | |
| DE | G 90 04 451.7 | | | 8/1990 | |
| DE | 42 15 273 | A1 | | 11/1993 | |
| DE | 195 03 948 | | | 8/1996 | |
| DE | 29911462 | | | 12/1999 | |
| EP | 0 024 360 | A1 | | 3/1981 | |
| EP | 0 161 233 | B1 | | 10/1987 | |
| EP | 0 248 127 | A1 | | 12/1987 | |
| EP | 0 562 402 | A1 | | 9/1993 | |
| EP | 0 715 037 | A1 | | 6/1996 | |
| EP | 0877130 | | | 11/1998 | |
| EP | 0855482 | | | 12/1999 | |
| EP | PCT/DE00/00870 | | | 5/2001 | |
| FR | 1215852 | | | 4/1960 | |
| FR | 1293043 | | | 12/1962 | |
| FR | 1511292 | | | 1/1968 | |
| FR | 2135372 | | | 12/1972 | |
| FR | 2416988 | | * | 9/1979 | 52/592.1 |
| FR | 2 568 295 | A1 | | 1/1986 | |
| FR | 2 691 491 | A1 | | 11/1993 | |
| GB | 424057 | | | 2/1935 | |
| GB | 599793 | | | 3/1948 | |
| GB | 812671 | | | 4/1959 | |
| GB | 1127915 | | | 9/1968 | |
| GB | 1 237 744 | | | 6/1971 | |
| GB | 1 275 511 | | | 5/1972 | |
| GB | 1 430 423 | | | 3/1976 | |
| GB | 2 117 813 | A | | 10/1983 | |
| GB | 2 256 023 | A | | 11/1992 | |
| JP | 03 169967 | A | | 7/1991 | |
| JP | 04203141 | | | 7/1992 | |
| JP | 05304714 | | | 11/1993 | |
| JP | 07 180333 | A | | 7/1995 | |
| JP | 08-109734 | | | 4/1996 | |
| SE | 7114900-9 | | | 12/1974 | |
| SE | 457 737 | | | 1/1989 | |
| WO | WO 84/02155 | A1 | | 6/1984 | |
| WO | WO 93/13280 | A1 | | 7/1993 | |
| WO | WO 01/02671 | A1 | | 1/2001 | |

* cited by examiner

METHOD FOR LAYING AND INTERLOCKING PANELS

This application is a continuation of PCT/DE00/00870 having an International filing date of Mar. 22, 2000 and which is incorporated herein by reference in its entirety.

The invention relates to a method for laying and interlocking panels, particularly via a fastening system consisting of positive retaining profiles provided on the narrow sides of the panels, which extend over the length of the narrow sides and are provided with joint projections or complementary joint recesses.

German utility model G 79 28 703 U1 describes a generic method for laying and interlocking floor panels with positive retaining profiles. These retaining profiles can be connected to each other by means of a rotary connecting movement. However, the disadvantage is that, in order to lay a second row of panels that is to be attached to a laid first row of panels, the second row first has to be completely assembled. The technical teaching to be taken from utility model G 79 28 703 U1 is that a first row of panels initially has to be laid ready horizontally and that a start is then made with a second panel in a second row, which has to be held at an angle and slid into a groove formed in the first panel row. The second panel has to be held at this angle, so that a third panel can be connected to the second panel. The same applies to the subsequent panels that have to be connected to each other in the second row. Only once all the panels of the second panel row have been pre-assembled in an inclined position can the entire second panel row be swung into horizontal position, this causing it to interlock with the first panel row. The unfavourable aspect of the laying method required for this panel design is the fact that several persons are required in order to hold all the panels of a second panel row in an inclined position for pre-assembly and then to jointly lower the second panel row into the laying plane. Another method for laying and interlocking panels is known from EP 0 855 482 A2. In this case, panels to be laid in the second row are again connected to the panels of a first row in an inclined position. Adjacent panels of the second row are initially interlocked with the panels of the first row, leaving a small lateral distance between them. In this condition, the panels of the second row can be displaced along the first row. Retaining profiles provided on the short narrow sides of the panels are pressed into each other by sliding two panels of the second row against each other. Disadvantageously, the retaining profiles are greatly expanded and elongated during this process. Even during assembly, the retaining profiles already suffer damage that impairs the durability of the retaining profiles. The retaining profiles designed and laid according to the teaching of EP 0 855 482 A2 are not suitable for repeated laying. For example, retaining profiles moulded from HDF or MDF material become soft as a result of the high degree of deformation to which the retaining profiles are subjected by the laying method according to EP 0 855 482 A2. Internal cracks and shifts in the fibre structure of the HDF or MDF material are responsible for this.

The object of the invention is thus to simplify the familiar method for laying and interlocking and to improve the durability of the fastening system.

According to the invention, the object is solved by a method for laying and interlocking rectangular, plate-shaped panels, particularly floor panels, the opposite long narrow sides and opposite short narrow sides of which display retaining profiles extending over the length of the narrow sides, of which the opposite retaining profiles are designed to be essentially complementary to each other, where a first row of panels is initially connected on the short narrow sides, either in that the complementary retaining profiles of a laid panel and a new panel are slid into each other in the longitudinal direction of the short narrow sides, or in that the retaining profile of a new panel is initially inserted in an inclined position relative to the laid panel having the complementary retaining profile of the laid panel and subsequently interlocked, both in the direction perpendicular to the connected narrow ends and in the direction perpendicular to the plane of the laid panels, by pivoting into the plane of the laid panel, the next step being to lay a new panel in the second row, in that the retaining profile of its long narrow side is initially inserted into the retaining profile of the long narrow side of a panel of the first row by positioning at an angle relative to it and subsequently pivoting into the plane of the laid panels, and where a new panel, the short narrow side of which must be interlocked with the short narrow side of the panel laid in the second row and the long narrow side of which must be connected to the long narrow side of a panel laid in the first row, is first interlocked with the panel of the second row at its short narrow end, the new panel then being pivoted upwards out of the plane of the laid panels along the long narrow side of a panel laid in the first row, where the panel of the second row that was previously interlocked with the new panel on the short narrow side is also pivoted upwards, at least at this end, together with the new panel, into an inclined position in which the long retaining profile of the new panel can be inserted into the complementary retaining profile of the panel laid in te first row and, after insertion, the inclined new panel and the panel interlocked with the new panel on a short narrow side in the second row are pivoted into the plane of the laid panels.

According to the new method, panels to be laid in the second row can be fitted by a single person. A new panel can be interlocked both with panels of a first row and with a previously laid panel of the second row. This does not require interlocking of the short narrow sides of two panels lying in one plane in a manner that expands and deforms the retaining profiles.

The last panel laid in the second row can be gripped by its free, short narrow end and can be pivoted upwards into an inclined position about the interlocked, long narrow side as the pivoting axis. The panel is slightly twisted about its longitudinal axis in this process. The result of this is that the free, short narrow end of the panel is in an inclined position and the inclination decreases towards the interlokked, short narrow end of the panel. Depending on the stiffness of the panels, this can result in more or less strong torsion and thus in a greater or lesser decrease in the inclination. In the event of relatively stiff panels, the inclination can continue through several of the previous panels in the second row.

When laying, it is, of course, not necessary for the first row to be laid completely before making a start on laying the second row. During laying, attention must merely be paid to ensuring that the number of elements in the first row is greater than that in the second row, and so on.

The method can be realised particularly well when using thin, easily twisted panels. The inclination of a thin panel located in the second row decreases over a very short distance when subjected to strong torsion. The non-twisted remainder of a panel, or of a panel row, located in the laying plane, is securely interlocked. Only on the short, inclined part of the last panel of the second row can the retaining profiles of the long narrow sides become disengaged during the laying work. However, they can easily be re-inserted together with the new panel attached at the short narrow side.

A particularly flexible and durable design is one consisting of rectangular, plate-shaped panels that display complementary retaining profiles extending over the length of the narrow sides on narrow sides parallel to each other, where one retaining profile is provided in the form of a joint projection with a convex curvature and the complementary retaining profile in the form of a joint recess with a concave curvature, where each joint projection of a new panel is inserted into the joint recess of a laid panel, expanding it only slightly, and the new panel is finally interlocked by pivoting into the plane of the laid panel. The deformation of the retaining profiles required for laying and interlocking is considerably smaller than with retaining profiles that have to be pressed together perpendicular to their narrow sides in the laying plane. Advantageously, the joint projection does not protrude from the narrow side by more than the thickness of the panel. In this way, another advantage lies in the fact that the retaining profile can be milled on the narrow side of a panel with very little waste.

When laid, the retaining profiles of the long narrow sides of two panels, which can also be referred to as form-fitting profiles, form a common joint, where the upper side of the joint projection facing away from the substrate preferably displays a bevel extending to the free end of the joint projection, and where the bevel increasingly reduces the thickness of the joint projection towards the free end and the bevel creates freedom of movement for the common joint.

The design permits articulated movement of two connected panels. In particular, two connected panels can be bent upwards at the point of connection. If, for example, one panel lies on a substrate with an elevation, with the result that one narrow side of the panel is pressed onto the substrate when loaded and the opposite narrow side rises, a second panel fastened to the rising narrow side is also moved upwards. However, the bending forces acting in this context do not damage the narrow cross-sections of the form-fitting profiles. An articulated movement takes place instead.

A floor laid using the proposed fastening system displays an elasticity adapted to irregularly rough or undulating substrates. The fastening system is thus particularly suitable for panels for renovating uneven floors in old buildings. Of course, it is also more suitable than the known fastening system when laying panels on a soft intermediate layer.

The design caters to the principle of "adapted deformability". This principle is based on the knowledge that very stiff, and thus supposedly stable, points of connection cause high notch stresses and can easily fail as a result. In order to avoid this, components are to be designed in such a way that they display a degree of elasticity that is adapted to the application, or "adapted deformability", and that notch stresses are reduced in this way.

Moreover, the form-fitting profiles are designed in such a way that a load applied to the upper side of the floor panels in laid condition is transmitted from the upper-side wall of the joint recess of a first panel to the joint projection of the second panel and from the joint projection of the second panel into the lower-side wall of the first panel. When laid, the walls of the joint recess of the first panel are in contact with the upper and lower side of the joint projection of the second panel. However, the upper wall of the joint recess is only in contact with the joint projection of the second panel in a short area on the free end of the upper wall of the joint recess. In this way, the design permits articulated movement between the panel with the joint recess and the panel with the joint projection, with only slight elastic deformation of the walls of the joint recess. In this way, the stiffness of the connection is optimally adapted to an irregular base which inevitably leads to a bending movement between panels connected to each other.

Another advantage is seen as lying in the fact that the laying and interlocking method according to the invention is more suitable for repeated laying that the known methods, because the panels display no damage to the form-fitting profiles after repeated laying and after long-term use on an uneven substrate. The form-fitting profiles are dimensionally stable and durable. They can be used for a substantially longer period and re-laid repeatedly during their life cycle.

Advantageously, the convex curvature of the joint projection and the concave curvature of the joint recess each essentially form a segment of a circle where, in laid condition, the centre of the circle of the segments of the circle is located on the upper side of the joint projection or below the upper side of the joint projection. In the latter case, the centre of the circle is located within the cross-section of the joint projection.

This simple design results in a joint where the convex curvature of the joint projection is designed similarly to the ball, and the concave curvature of the joint recess similarly to the socket, of a ball-and-socket joint, where, of course, in contrast to a ball-and-socket joint, only planar rotary movement is possible and not spherical rotary movement.

In a favourable configuration, the point of the convex curvature of the joint projection of a panel that protrudes farthest is positioned in such a way that it is located roughly below the top edge of the panel. This results in a relatively large cross-section of the joint projection in relation to the overall thickness of the panel. Moreover, the concave curvature of the joint recess offers a sufficiently large undercut for the convex curvature of the joint projection, so that they can hardly be moved apart by tensile forces acting in the laying plane.

The articulation properties of two panels connected to each other can be further improved if the inside of the wall of the joint recess of a panel that faces the substrate displays a bevel extending up to the free end of the wall and the wall thickness of this wall becomes increasingly thin towards the free end. In this context, when two panels are laid, the bevel creates space for movement of the common joint. This improvement further reduces the amount of elastic deformation of the walls of the joint recess when bending the laid panels upwards.

It is also expedient if the joint recess of a panel for connecting to the joint projection of a second panel can be expanded by resilient deformation of its lower wall and the resilient deformation of the lower wall occurring during connection is eliminated again when connection of the two panels is complete. As a result, the form-fitting profiles are only elastically deformed for the connection operation and during joint movement, not being subjected to any elastic stress when not loaded.

The ability also to connect the short narrow ends of two panels in articulated fashion benefits the resilience of a floor covering.

The form-fitting profiles preferably form an integral part of the narrow sides of the panels. The panels can be manufactured very easily and with little waste.

The laying method is particularly suitable if the panels consist essentially of an MDF (medium-density fibreboard), HDF (high-density fibreboard) or particle board material. These materials are easy to process and can be given a sufficient surface quality by means of cutting processes, for example. In addition, these materials display good dimensional stability of the milled profiles.

An example of the invention is illustrated in a drawing and described in detail below on the basis of FIGS. 1 to 6. The figures show the following:

FIG. 1 Part of a fastening system on the basis of the cross-sections of two panels prior to connection, FIG. 2 The fastening system as per FIG. 1 in assembled condition, FIG. 3A connecting procedure, where the joint projection of one panel is inserted in the joint recess of a second panel in the direction of the arrow and the first panel is subsequently locked in place by a rotary movement, FIG. 4A further connecting procedure, where the joint projection of a first panel is slid into the joint recess of a second panel parallel to the laying plane, FIG. 5 The fastening system in fastened condition as per FIG. 2, where the common joint is moved upwards out of the laying plane and the two panels form a bend, FIG. 6 The fastening system in laid condition as per FIG. 2, where the joint is moved downwards out of the laying plane and the two panels form a bend, FIG. 7A fastening system in the laid condition of two panels, with a filler material between the form-fitting profiles of the narrow sides, FIG. 8A perspective representation of the method for laying and interlocking rectangular panels, FIG. 9 An alternative method for laying and interlocking rectangular panels.

According to the drawing, fastening system 1, required for the method for laying and interlocking rectangular panels, is explained based on oblong, rectangular panels 2 and 3, a section of which is illustrated in FIG. 1. Fastening system 1 displays retaining profiles, which are located on the narrow sides of the panels and designed as complementary form-fitting profiles 4 and 5. The opposite form-fitting profiles of a panel are of complementary design in each case. In this way, a further panel 3 can be attached to every previously laid panel 2.

Form-fitting profiles 4 and 5 are based on the prior art according to German utility model G 79 28 703 U1, particularly on the form-fitting profiles of the practical example.

The form-fitting profiles according to the invention are developed in such a way that they permit the articulated and resilient connection of panels.

One of the form-fitting profiles 4 of the present invention is provided with a joint projection 6 protruding from one narrow side. For the purpose of articulated connection, the lower side of joint projection 6, which faces the base in laid condition, displays a cross-section with a convex curvature 7. Convex curvature 7 is mounted in rotating fashion in complementary form-fitting profile 5. In the practical example shown, convex curvature 7 is designed as a segment of a circle. Part 8 of the narrow side of panel 3, which is located below joint projection 6 and faces the base in laid condition, stands farther back from the free end of joint projection 6 than part 9 of the narrow side, which is located above joint projection 6. In the practical example shown, part 8 of the narrow side, located below joint projection 6, recedes roughly twice as far from the free end of joint projection 6 and part 9 of the narrow side, located above joint projection 6. The reason for this is that the segment of a circle of convex curvature 7 is of relatively broad design. As a result, the point of convex curvature 7 of joint projection 6 that projects farthest is positioned in such a way that it is located roughly below top edge 10 of panel 3.

Part 9 of the narrow side, located above joint projection 6, protrudes from the narrow side on the top side of panel 3, forming abutting joint surface 9*a*. Part 9 of the narrow side recedes between this abutting joint surface 9*a* and joint projection 6. This ensures that part 9 of the narrow side always forms a closed, top-side joint with the complementary narrow side of a second panel 2.

The upper side of joint projection 6 opposite convex curvature 7 of joint projection 6 displays a short, straight section 11 that is likewise positioned parallel to substrate U in laid condition. From this short section 11 to the free end, the upper side of joint projection 6 displays a bevel 12, which extends up to the free end of joint projection 6.

Form-fitting profile 5 of a narrow side, which is complementary to form-fitting profile 4 described, displays a joint recess 20. This is essentially bordered by a lower wall 21, which faces substrate U in laid condition, and an upper wall 22. On the inside of joint recess 20, lower wall 21 is provided with a concave curvature 23. Concave curvature 23 is likewise designed in the form of a segment of a circle. In order for there to be sufficient space for the relatively broad concave curvature 23 on lower wall 21 of joint recess 20, lower wall 21 projects farther from the narrow side of panel 2 than upper wall 22. Concave curvature 23 forms an undercut at the free end of lower wall 21. In finish-laid condition of two panels 2 and 3, this undercut is engaged by joint projection 6 of associated form-fitting profile 4 of adjacent panel 3. The degree of engagement, meaning the difference between the thickest point of the free end of the lower wall and the thickness of the lower wall at the lowest point of concave curvature 23, is such that a good compromise is obtained between flexible resilience of two panels 2 and 3 and good retention to prevent form-fitting profiles 4 and 5 being pulled apart in the laying plane.

In comparison, the fastening system of the prior art utility model G 79 28 703 U1 displays a considerably greater degree of undercut. This results in extraordinarily stiff points of connection, which cause high notch stresses when subjected to stress on an uneven substrate.

According to the practical example, the inner side of upper wall 22 of joint recess 20 of panel 2 is positioned parallel to substrate U in laid condition.

On lower wall 21 of joint recess 20 of panel 2, which faces substrate U, the inner side of wall 21 has a bevel 24, which extends up the free end of lower wall 21. As a result, the wall thickness of this wall becomes increasingly thin towards the free end. According to the practical example, bevel 24 follows on from the end of concave curvature 23.

Figure 2:
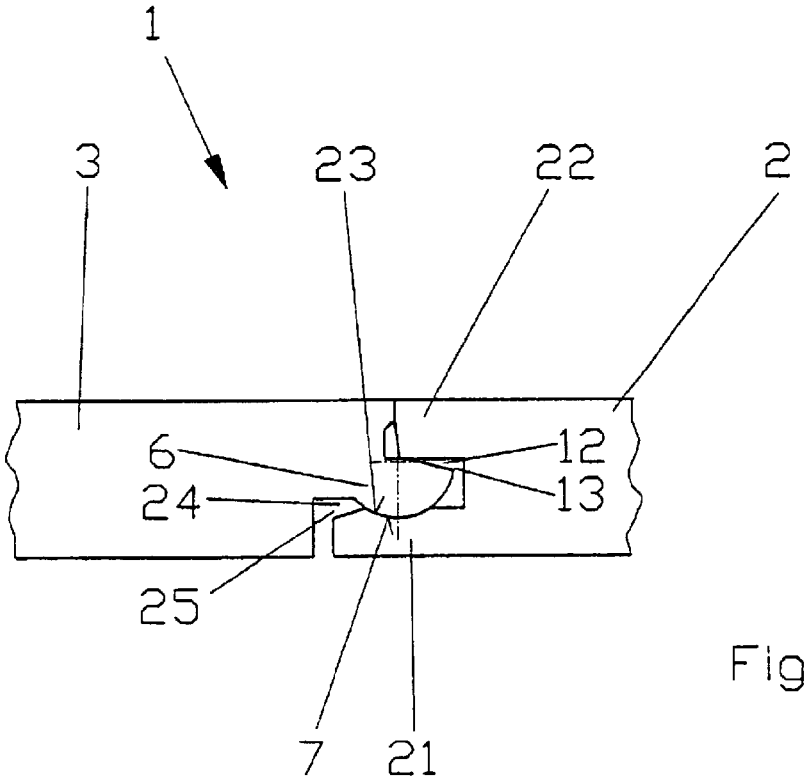
Figure 3:
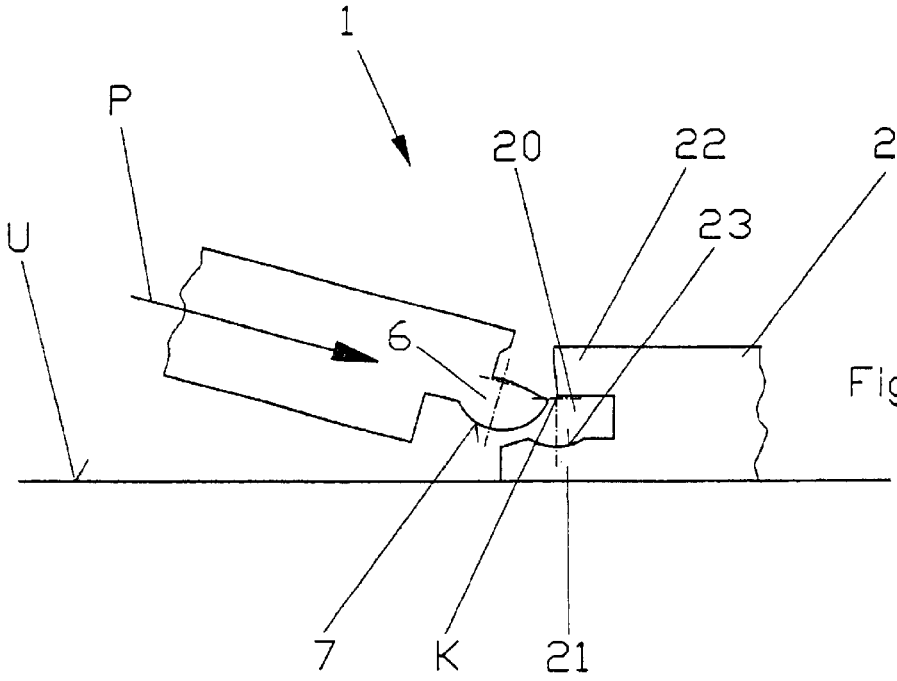

Joint projection 6 of panel 3 and joint recess 20 of panel 2 form a common joint G, as illustrated in FIG. 2. When panels 2 and 3 are laid, the previously described bevel 12 on the upper side of joint projection 6 of panel 3 and bevel 24 of lower wall 21 of joint recess 20 of panel 2 create spaces for movement 13 and 25, which allow joint G to rotate over a small angular range.

In laid condition, short straight section 11 of the upper side of joint projection 6 of panel 3 is in contact with the inner side of upper wall 22 of joint recess 20 of panel 2. Moreover, convex curvature 7 of joint projection 6 lies against contact curvature 23 of lower wall 21 of joint recess 20 of panel 2.

Lateral abutting joint surfaces 9*a* and 26 of two connected panels 2 and 3, which face the upper side, are always definitely in contact. In practice, simultaneous exact positioning of convex curvature 7 of joint projection 6 of panel 3 against concave curvature 23 of joint recess 20 of panel 2 is impossible. Manufacturing tolerances would lead to a situation where either abutting joint surfaces 9*a* and 26 are positioned exactly against each other or joint projection 6/recess 20 are positioned exactly against each other. In practice, the form-fitting profiles are thus designed in such a way that abutting joint surfaces 9*a* and 26 are always exactly positioned against each other and joint projection 6/recess 20 cannot be moved far enough in each other to achieve an exact fit. However, as the manufacturing tolerances are in the region of hundredths of a millimetre, joint projection 6/recess 20 also fit almost exactly.

Panels 2 and 3, with complementary form-fitting profiles 4 and described, can be fastened to each other in a variety of ways. According to FIG. 3, one panel 2 with a joint recess 20 has already been laid, while a second panel 3, with a complementary joint projection 6, is being inserted into joint recess 20 of first panel 2 at an angle in the direction of the arrow P. After this, second panel 3 is rotated about the common centre of circle K of the segments of a circle of convex curvature 7 of joint projection 6 and concave curvature 23 of joint recess 20 until second panel 3 lies on substrate U.

Figure 4:
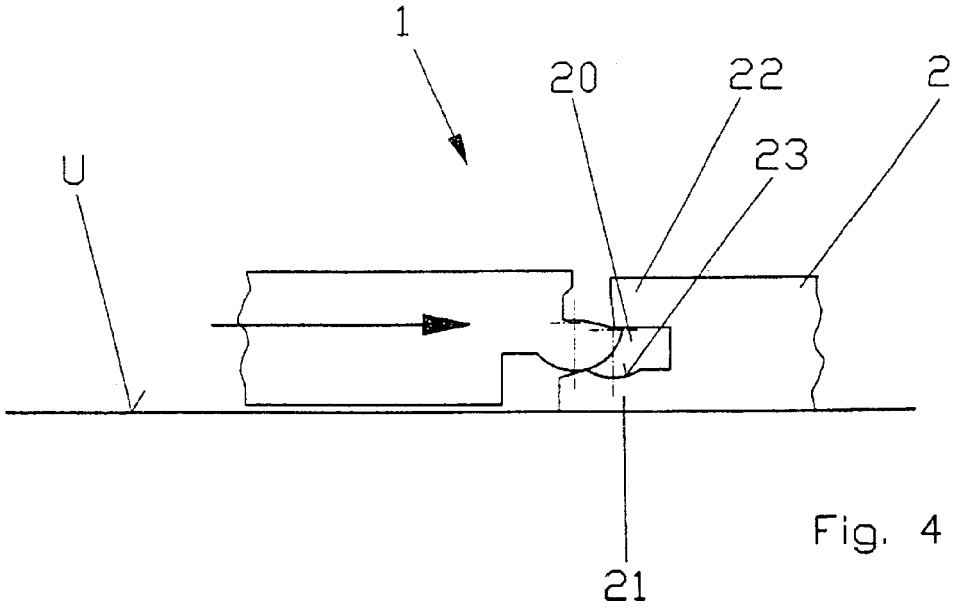

Another way of joining the previously described panels 2 and 3 is illustrated in FIG. 4, according to which first panel 2 with joint recess 20 has been laid and a second panel 3 with joint projection 6 is slid in the laying plane and perpendicular to form-fitting profiles 4 and 5 in the direction of the arrow P until walls 21 and 22 of joint recess 20 expand elastically to a small extent and convex curvature 7 of joint projection 6 has overcome the undercut at the front end of concave curvature 23 of the lower wall and the final laying position is reached.

The latter way of joining is preferably used for the short narrow sides of a panel if these are provided with the same complementary form-fitting profiles 4 and 5 as the long narrow sides of the panels.

Figure 5:
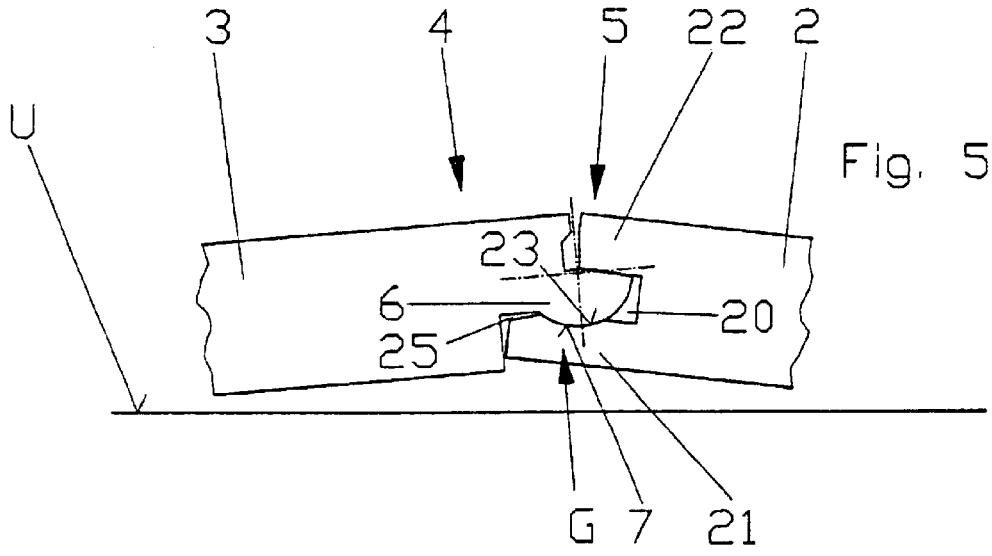

FIG. 5 illustrates fastening system 1 in use. Panels 2 and 3 are laid on an uneven substrate U. A load has been applied to the upper side of first panel 2 with form-fitting profile 5. The narrow side of panel 2 with form-fitting profile 5 has been lifted as a result. Form-fitting profile 4 of panel 3, which is connected to form-fitting profile 5, has also been lifted. Joint G results in a bend between the two panels 2 and 3. The spaces for movement 13 and 25 create room for the rotary movement of the joint. Joint G, formed by the two panels 2 and 3, has been moved slightly upwards out of the laying plane. Space for movement 13 has been utilised to the full for rotation, meaning that the area of bevel 12 on the upper side of joint projection 6 of panel 3 is in contact with the inner side of wall 22 of panel 2. The point of connection is inherently flexible and does not impose any unnecessary, materialfatiguing bending loads on the involved form-fitting profiles 4 and 5.

The damage soon occurring in form-fitting profiles according to the prior art, owing to the breaking of the joint projection or the walls of the form-fitting profiles, is avoided in this way.

Another advantage results in the event of movement of the joint in accordance with FIG. 5. This can be seen in the fact that, upon relief of the load, the two panels drop back into the laying plane under their own weight. Slight elastic deformation of the walls of the joint recess is also present in this case. This elastic deformation supports the panels in dropping back into the laying plane. Only very slight elastic deformation occurs because the centre of motion of the joint, which is defined by curvatures 7 and 23 with the form of a segment of a circle, is located within the cross-section of joint projection 6 of panel 3.

Figure 6:
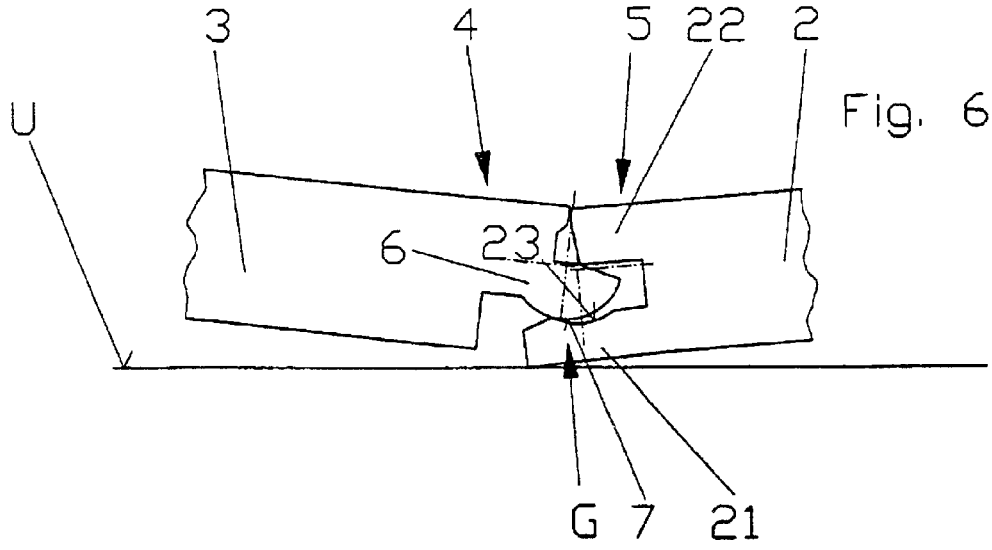

FIG. 6 illustrates movement of the joint of two laid panels 2 and 3 in the opposite sense of rotation. Panels 2 and 3, laid on uneven substrate U, are bent downwards. The design is such that, in the event of downward bending of the point of connection out of the laying plane towards substrate U, far more pronounced elastic deformation of lower wall 21 of joint recess 20 occurs than during upward bending from the laying plane. This measure is necessary because downward-bent panels 2 and 3 cannot return to the laying plane as a result of their own weight when the load is relieved. However, the greater elastic deformation of lower wall 21 of joint recess 20 generates an elastic force which immediately moves panels 2 and 3 back into the laying plane in the manner of a spring when the load is relieved.

In the present form, the previously described form-fitting profiles 4 and 5 are integrally moulded on the narrow sides of panels 2 and 3. This is preferably achieved by means of a so-called formatting operation, where the shape of form-fitting profiles 4 and 5 is milled into the narrow sides of panels 2 and 3 by a number of milling tools connected in series. Panels 2 and 3 of the practical example described essentially consist of MDF board with a thickness of 8 mm. The MDF board has a wear-resistant and decorative coating on the upper side. A so-called counteracting layer is applied to the lower side in order to compensate for the internal stresses caused by the coating on the upper side.

Figure 7:
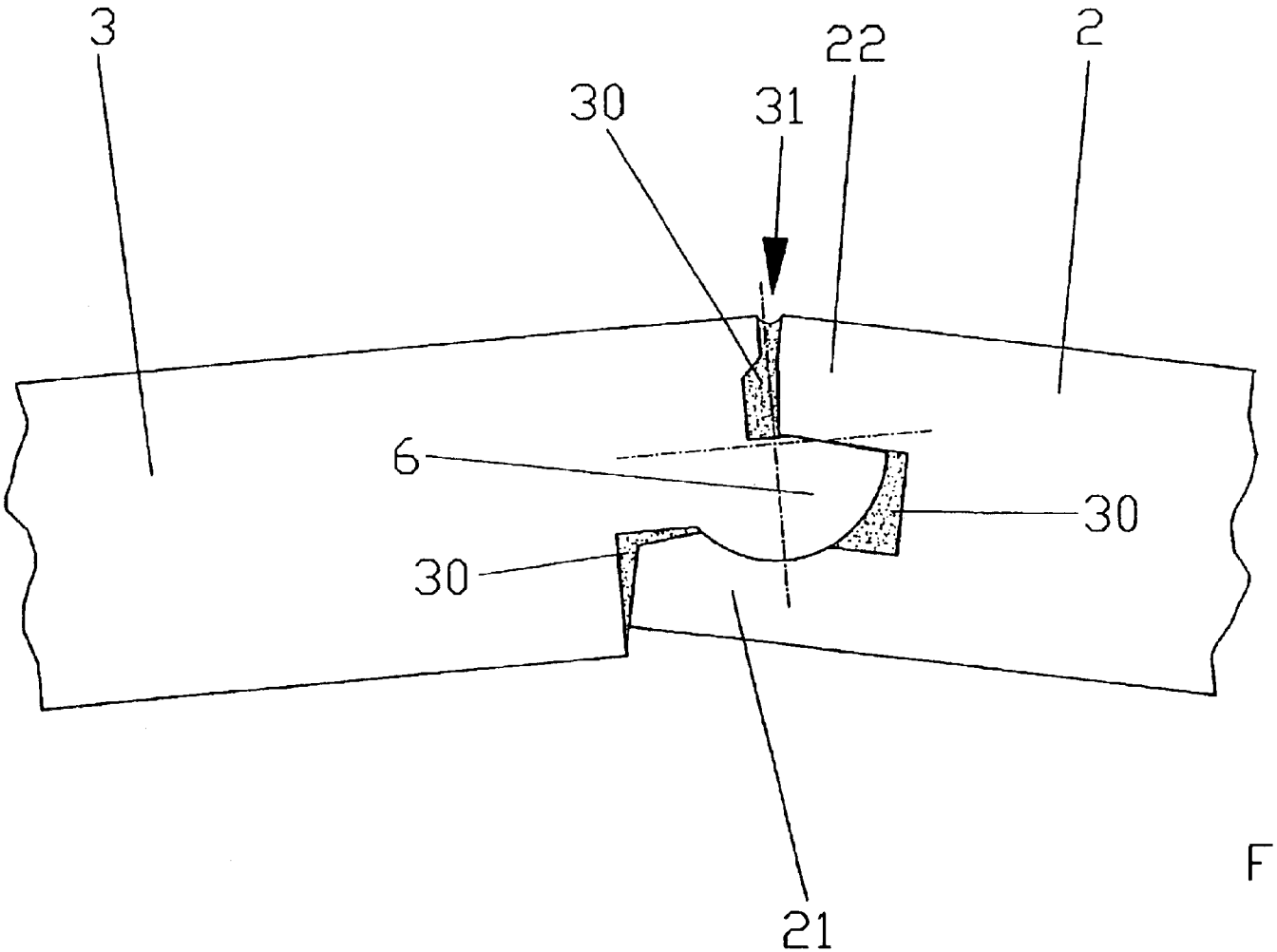

Finally, FIG. 7 shows two panels 2 and 3 in laid condition, where fastening system 1 is used with a filler 30 that remains flexible after curing. Filler 30 is provided between all adjacent parts of the positively connected narrow sides. In particular, the top-side joint 31 is sealed with the filler to prevent the ingress of any moisture or dirt. In addition, the elasticity of filler 30, which is itself deformed when two panels 2 and 3 are bent, brings about the return of panels 2 and 3 to the laying plane.

Figure 8:
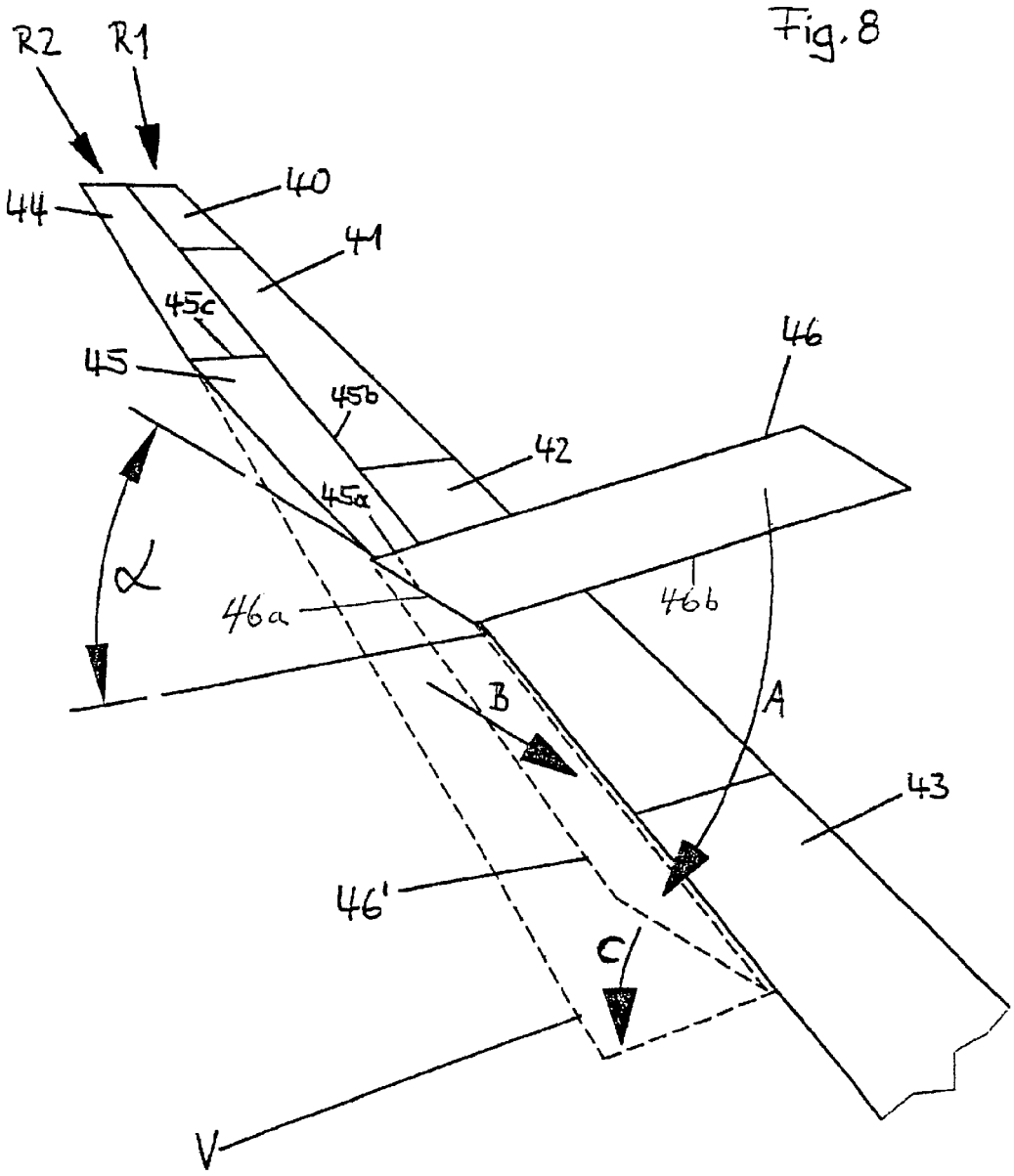

FIG. 8 shows a perspective representation of the laying of a floor, where the method for laying and interlocking panels according to the invention is used. For the sake of the simplicity of the drawing, the details of the retaining profiles have been omitted. However, these correspond to the form-fitting profiles in FIGS. 1 to 7 and display profiled joint projections and complementary joint recesses that extend over the entire length of the narrow sides.

A first row Rl, comprising rectangular, plate-like panels 40, 41, 42 and 43, can be seen. Panels 40, 41, 42 and 43 of first row R1 are preferably laid in such a way that joint recesses are always located on the free sides of a laid panel and new panels can be attached by their joint projections to the joint recesses of the laid panels.

Panels 40, 41, 42 and 43 of fist row Rl have been interlocked at their short sides. This can be done either in the laying plane by sliding the panels laterally into each other in the longitudinal direction of the retaining profiles of the short narrow sides or, alternatively, by joining the retaining profiles while positioning a new panel at an an@e relative to a laid panel and subsequently pivoting the new panel into the laying plane. The laying plane is indicated by broken line v in FIGS. 8 and 9. The retaining profiles have been interlocked without any major deformation in both cases. The panels are interlocked in the direction perpendicular to the laying plane. Moreover, they are also interlocked in the direction perpendicular to the plane of the narrow sides.

Panels 44, 45 and 46 are located in a second row R2. First of all, the long side of panel 44 was interlocked by inserting its joint projection by positioning it at an angle relative to the panels of first row R1 and subsequently pivoting panel 44 into the laying plane.

Figure 9:
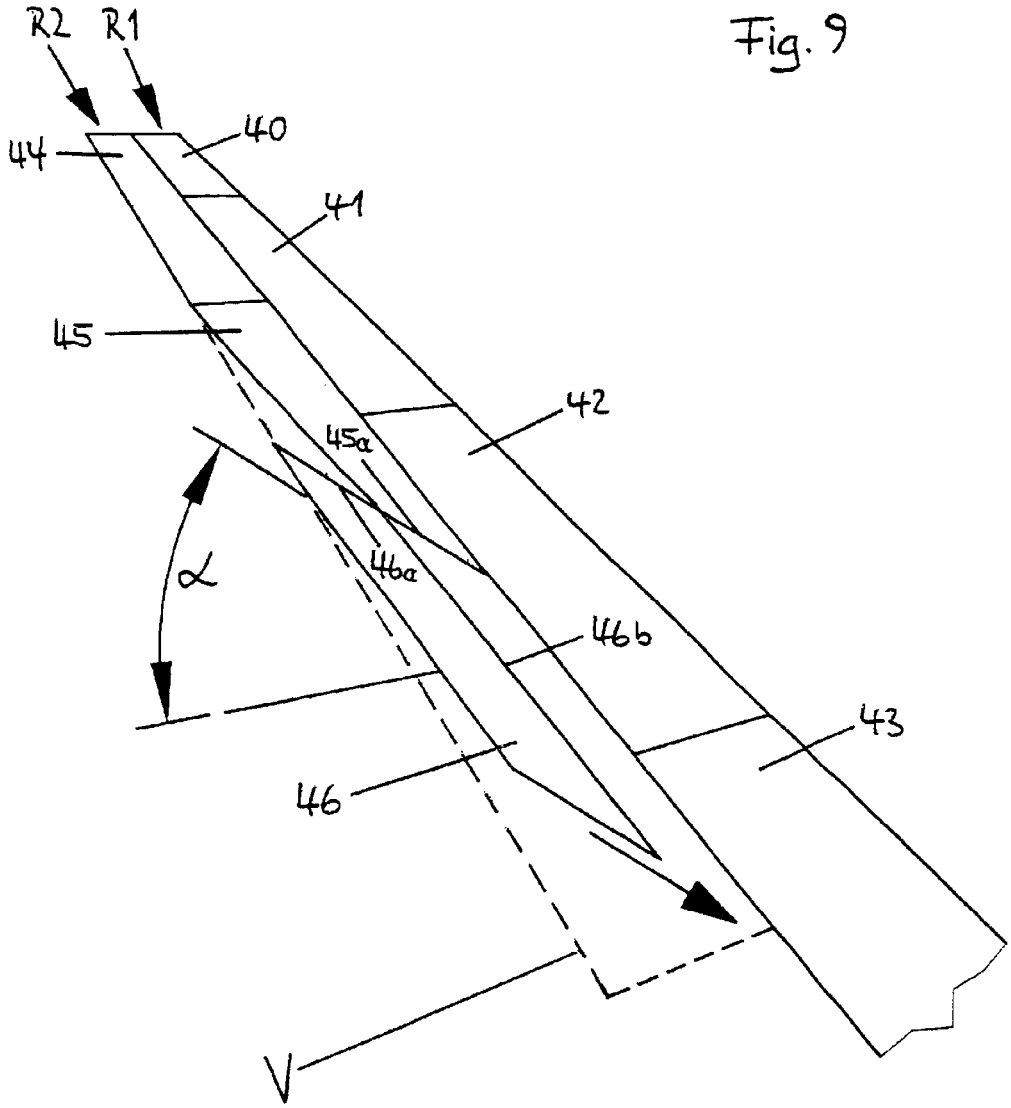

In order to lay a new panel in the second row, several alternative procedural steps can be performed, two alternatives of which are described on the basis of FIGS. 8 and 9. A further alternative is explained without an illustration.

When laying a new panel 46 in the second row, one of its long sides has to be interlocked with first row R1 and one of its short sides with laid panel 45. A short side of new panel 46 is always first interlocked with laid panel 45.

According to FIG. 8, free end 45*a* is pivoted upwards out of the laying plane through a pivoting angle α about interlocked long narrow side 45*b*. Panel 45 is twisted in such a way during the process that the dimension of pivoting angle α decreases from free end 45*a* towards interlocked end 45*c*. According to FIG. 8, interlocked end 45*c* remains in place in the laying plane. In this position, new panel 46 is set at an angle relative to panel 45 on free end 45*a* of the latter. Panel 46 can initially not be set against the whole length of the short side, because panel 45 is already interlocked with panels 41 and 42 of the first row. Panel 46 is now pivoted in the direction of arrow A until it is likewise positioned at pivoting angle α relative to the laying plane, as indicated by dotted pivoting position 46'. In pivoting position 46', panel 46 is slid in the direction of arrow B and the joint projection of panel 46 is inserted into the joint recess of panels 42 and 43 of first row R1. In this context, the short narrow side of panel 46 is simultaneously slid completely onto short narrow side 45*a* of panel 45. Finally, panels 45 and 46 are jointly pivoted into the laying plane in the direction of arrow C and interlocked with the panels of first row R1.

Damage to the retaining profiles due to a high degree of deformation during laying and interlocking is avoided.

The alternative laying method according to FIG. 9 likewise provides for free end 45*a* to be pivoted upwards out of the laying plane by a pivoting angle α about interlocked long narrow side 45*b*, where panel 45 is twisted and its free end 45*a* is inclined through a pivoting angle α relative to the laying plane. Interlocked end 45*c* again remains in place in the laying plane. In contrast to FIG. 8, panel 46 is now likewise positioned at the pivoting angle α relative to the laying plane and its short side 46*a* is slid in the longitudinal direction onto the retaining profile of short side 45*a* of panel 45. In this inclined position, the joint projection of long side 46*b* of panel 46 is immediately inserted into the joint recess of panels 42 and 43 of first row R1. Finally, panels 45 and 46 are jointly pivoted into the laying plane and interlokked with the panels of first row R1.

The alternatives not shown for laying and interlocking panels consist in first interlocking the short narrow ends of panels 45 and 46 in the laying plane. The alternatives described here can be followed by examining FIGS. 8 and 9, which is why reference numbers are also given for the alternatives not illustrated.

According to one of the alternatives, the retaining profiles of short narrow sides 45*a* and 46*a* of panels 45 and 46 are slid into each other in the longitudinal direction while both panels 45 and 46 remain in place in the laying plane. According to another alternative, panel 45 lies in the laying plane and panel 46 is set at an angle against short narrow side 45*a* of panel 45 and then pivoted into the laying plane.

According to the above alternative procedural steps for interlocking panels 45 in the laying plane, the long side of panel 46 is not yet interlocked with panels 42 and 43 of first row R1. To this end, panel 46 and end 45*a* of panel 45 must be lifted into the previously described inclined position at pivoting angle α. The joint projection of long side 46*b* of panel 46 is then inserted into the joint recess of panels 42 and 43 of first row R1, and panels 45 and 46 are finally jointly interlocked with panels 42 and 43 of first row R1 by being pivoted into laying plane V.

List of Reference Numbers

1 Fastening system
2 Panel
3 Panel
4 Form-fitting profile
5 Form-fitting profile
6 Projection
7 Convex curvature
8 Part of the narrow side
9 Part of the narrow side
9*a* Abutting joint surface
10 Top edge
11 Section
12 Bevel
13 Space for movement
20 Recess
21 Lower wall
22 Upper wall
23 Concave curvature
24 Bevel
25 Space for movement
26 Abutting joint surface
30 Filler
31 Top-side joint
G Joint
K Centre of circle
P Arrow
U Substrate
R1 First row
R2 Second row
40 Panel
41 Panel
42 panel
43 Panel
44 Panel
45 Panel
45*a* Short narrow side/Free end
45*b* Long narrow side
45*c* Short narrow side/Interlocked end
46 Panel
46*a* Short narrow side
46*b* Long narrow side
46' Dotted pivoting position
α Pivoting angle
V laying plane

What is claimed is:

1. A rectangular floor panel, comprising:

a joint projection edge, provided on at least a first edge of the panel, complementary to and adapted to project into ajoint recess of an adjacent panel of the same structure to form a common joint, the joint projection edge comprising a joint projection having a single convex curvature on a lower portion thereof; and a joint recess edge, provided on at least a second edge of the panel, complementary to and adapted to receive ajoint projection of an adjacent panel of the same structure to form a common joint, the joint recess edge comprising a joint recess having a single concave curvature on a lower portion thereof;

said joint projection edge and said joint recess edge forming elements of an articulating joint which, when joined with a complementary element of an adjacent panel, enables upper surfaces of adjacent panels to angularly displace with respect to one another such that said panels can form a bend at said articulating joint; wherein the joint projection projects from the panel by a distance that is no greater than a thickness of the panel.

2. The rectangular floor panel according to claim 1, wherein the single convex curvature and the single concave curvature each form a segment of a circle.

3. The rectangular floor panel according to claim 1, wherein the single convex curvature and the single concave curvature are arcuate.

4. The rectangular floor panel according to claim 1, wherein a convex curvature is provided only on the lower portion of the joint projection, and wherein a concave curvature is provided only on the lower portion of the joint recess.

5. The rectangular floor panel according to claim 1, wherein the joint projection edge further comprises:

a top edge of the joint projection edge, above the joint projection, which is perpendicular to the plane of the panel and forms an abutting joint surface; and a bottom edge of the joint projection edge, below the joint projection, which is perpendicular to the plane of the panel and further from an end of the joint projection than is the top edge of the joint projection edge.

6. The rectangular floor panel according to claim 5, wherein a lowest point of the convex curvature of the joint projection is approximately below the abutting joint surface of the top edge of the joint projection edge.

7. The rectangular floor panel according to claim 5, wherein a center of a circle defined by the convex curvature of the lower portion of the joint projection is located at or below the top edge of thejoint projection edge.

8. The rectangular floor panel according to claim 5, wherein the bottom edge of the joint projection edge extends approximately as far from the end of the joint projection than does the top edge of the joint projection edge.

9. The rectangular floor panel according to claim 1, wherein an upper portion of the joint projection comprises:

a short straight section, adjacent the panel, which is parallel to the plane of the panel; and a beveled section, adjacent the short straight section, which angles downward with respect to the plane of the panel and extends to an end of the joint projection.

10. The rectangular floor panel according to claim 1, wherein the joint recess edge further comprises:

an upper wall of the joint recess, which forms an upper portion of the joint recess, an inner portion of which is substantially parallel to the plane of the panel; and a lower wall of the joint recess, which forms the lower portion of the joint recess having the concave curvature, and which extends further from the panel than does the upper wall of the joint recess.

11. The rectangular floor panel according to claim 10, wherein the lower wall of the joint recess, between the concave curvature of the joint recess and an end of the lower wall, is provided with a beveled portion which angles downward to the end of the lower wall, so that a thickness of the lower wall decreases toward the end.

12. The rectangular floor panel according to claim 10, wherein the upper wall of the joint recess is provided at an end of the upper wall with an abutting joint surface that is perpendicular to the plane of the panel.

13. The rectangular floor panel according to claim 1, wherein opposite short sides of the panel are provided with approximately rectangular, complementary tongue-and-groove cross-section edges.

14. The rectangular floor panel according to claim 1, wherein a third edge of the panel is provided with a joint projection edge, complementary to and adapted to project into a joint recess of an adjacent panel of the same structure to form a common joint, the joint projection edge of the third edge of the panel comprising a joint projection having a single convex curvature on a lower portion thereof, and wherein a fourth edge of the panel is provided with a joint recess edge, complementary to and adapted to receive ajoint projection of an adjacent panel of the same structure to form a common joint, the joint recess edge of the fourth edge of the panel comprising a joint recess having a single concave curvature on a lower portion thereof.

15. A method ofjoining a new rectangular floor panel according to claim 14 to a first panel of the same structure provided in a first row, and to a second panel of the same structure provided in a second row, the method comprising:

placing the new panel adjacent a long edge of the first panel in the first row, and adjacent a short edge of the second panel in the second row;

joining either ajoint projection edge of the new panel or ajoint recess edge of the new panel with a complementary edge of the second panel, while maintaining the new and second panels in a common plane, so that the convex curvature of the joint projection and the concave curvature of the joint recess engage one another to form a common joint; and joining either a joint projection edge of the new panel or ajoint recess edge of the new panel into a complementary edge of the first panel, while maintaining the new and first panels in a common plane, so that the convex curvature of the joint projection and the concave curvature of the joint recess engage one another to form a common joint.

16. The method according to claim 15, wherein each of the common joints secures the joined panels in a direction perpendicular to the joined edges, and in a direction perpendicular to the plane of the joined panels.

17. The method according to claim 15, wherein each of the common joints permits articulated movement about the joint.

18. The method according to claim 15, wherein each of the common joints permits planar rotary movement about the joint.

19. A method ofjoining a new rectangular floor panel according to claim 14 to a first panel of the same structure provided in a first row, and to a second panel of the same structure provided in a second row, the method comprising:

placing the new panel adjacent a long edge of the first panel in the first row, and adjacent a short edge of the second panel in the second row;

joining either ajoint projection edge of the new panel or ajoint recess edge of the new panel with a complementary edge of the second panel, while maintaining the new panel in an inclined position with respect to the second panel;

angling down the new panel into a common plane with the second panel, so that the convex curvature of the joint projection and the concave curvature of the joint recess engage one another;

angling up the new panel with respect to the first panel, while angling up the portion of the second panel engaged with the new panel while leaving the opposite short end of the second panel engaged with an adjacent panel in the second row;

joining either ajoint projection edge of the new panel or ajoint recess edge of the new panel with a complementary edge of the first panel, while maintaining the new panel, and the portion of the second panel engaged with the new panel, in an inclined position with respect to the first panel; and angling down the new panel and the portion of the second panel engaged with the new panel into a common plane with the first panel, so that the convex curvature of the joint projection and the concave curvature of the joint recess engage one another.

20. The method according to claim 19, wherein each of the common joints secures the joined panels in a direction perpendicular to the joined edges, and in a direction perpendicular to the plane of the joined panels.

21. The method according to claim 19, wherein each of the common joints pennits articulated movement about the joint.

22. The method according to claim 19, wherein each of the common joints permits planar rotary movement about the joint.

23. The method according to claim 19, wherein the angling up of the new panel with respect to the third panel, while angling up the portion of the second panel engaged with the new panel while leaving the opposite short end of the second panel engaged with an adjacent panel in the second row, causes the second panel to twist along its longitudinal axis.

24. A method of joining a new rectangular floor panel according to claim 14 to a first panel of the same structure provided in a first row, and to a second panel of the same structure provided in a second row, the method comprising:

placing the new panel adjacent a long edge of the first panel in the first row, and adjacent a short edge of the second panel in the second row;

angling up a first short end of the second panel while leaving the opposite short end of the second panel engaged with an adjacent panel in the second row;

joining either ajoint projection edge of the new panel or a joint recess edge of the new panel with a complementary edge of the first short end of the second panel, while maintaining the new panel in an inclined position with respect to the second panel;

angling down the new panel into a common plane with the second panel, so that the convex curvature of the joint projection and the concave curvature of the joint recess engage one another, joining either ajoint projection edge of the new panel or ajoint recess edge of the new panel with a complementary edge of the first panel, while maintaining the new panel, and the first short end of the second panel engaged with the new panel, in an inclined position with respect to the first panel; and angling down the new panel and the first short end of the second panel engaged with the new panel into a common plane with the first panel, so that the convex curvature of the joint projection and the concave curvature of the joint recess engage one another.

25. The method according to claim 24, wherein each of the common joints secures the joined panels in a direction perpendicular to the joined edges, and in a direction perpendicular to the plane of the joined panels.

26. The method according to claim 24, wherein each of the common joints permits articulated movement about the joint.

27. The method according to claim 24, wherein each of the common joints permits planar rotary movement about the joint.

28. The method according to claim 24, wherein the angling up of the new panel with respect to the third panel, while angling up the first short end of the second panel engaged with the new panel while leaving the opposite short end of the second panel engaged with an adjacent panel in the second row, causes the second panel to twist along its longitudinal axis.

29. The rectangular floor panel according to claim 1, wherein the panel is comprised of a material selected from the group consisting of medium-density fiberboard, high-density fiberboard, and particleboard material.

30. The rectangular floor panel according to claim 1, wherein the edges of the panels are integrally formed with the panels.

31. A method ofjoining a first rectangular floor panel according to claim 1 to a second rectangular floor panel of the same structure, the method comprising:

placing either the joint projection edge of the first panel or the joint recess edge of the first panel adjacent a complementary edge of the second panel; and joining the panels by inserting the joint projection into the joint recess, while maintaining the first and second panels in a common plane, so that the convex curvature of the joint projection and the concave curvature of the joint recess engage one another to form a common joint.

32. The method according to claim 31, wherein the inserting of thejoint projection into the joint recess causes resilient deformation of the lower wall of the joint recess during the inserting.

33. The method according to claim 31, wherein the common joint secures the joined panels in a direction perpendicular to the joined edges, and in a direction perpendicular to the plane of the joined panels.

34. The method according to claim 31, wherein the common joint permits articulated movement about the joint.

35. The method according to claim 31, wherein the common joint permits planar rotary movement about the joint.

36. A method ofjoining a first rectangular floor panel according to claim 1 to a second rectangular floor panel of the same structure, the method comprising:

placing either the joint projection edge of the first panel or the joint recess edge of the first panel adjacent a complementary edge of the second panel;

joining the panels by inserting the joint projection into the joint recess, while maintaining the first panel in an inclined position with respect to the second panel; and angling down the first panel into a common plane with the second panel, so that the convex curvature of the joint projection and the concave curvature of the joint recess engage one another to form a common joint.

37. The method according to claim 36, wherein the inserting of the joint projection into the joint recess causes resilient deformation of the lower wall of the joint recess during the inserting.

38. The method according to claim 36, wherein the common joint secures the joined panels in a direction perpendicular to the joined edges, and in a direction perpendicular to the plane of the joined panels.

39. The method according to claim 36, wherein the common joint permits articulated movement about the joint.

40. The method according to claim 36, wherein the common joint permits planar rotary movement about the joint.

41. A rectangular floor panel, comprising:

a joint projection edge, provided on a first edge of the panel, complementary to and adapted to project into ajoint recess of an adjacent panel of the same structure to form a common joint, the joint projection edge comprising:

a joint projection, having a single convex curvature on a lower portion thereof, and having an upper portion provided with a short straight section, adjacent the panel, which is parallel to the plane of the panel, and a beveled section, adjacent the short straight section, which angles downward and extends to an end of the joint projection, a top edge, above the joint projection, which is perpendicular to the plane of the panel and forms an abutting joint surface which extends to approximately above a lowest point of the convex curvature of the joint projection, and a bottom edge, below the joint projection, which is perpendicular to the plane of the panel, and which extends further from an end of the joint projection than does the top edge of the joint projection edge; and a joint recess edge, provided on a second edge of the panel, complementary to and adapted to receive ajoint projection of an adjacent panel of the same structure to form a common joint, the joint recess edge comprising:

a joint recess, having a single concave curvature on a lower portion thereof, an upper wall, which forms an upper portion of the joint recess, an upper portion of which is parallel to the plane of the panel, the upper wall being provided at an end thereof with an abutting joint surface which is perpendicular to the plane of the panel, and a lower wall, which forms the lower portion of the joint recess and extends further from the panel than does the upper wall of the joint recess, and which is provided, between the convex curvature of the joint recess and an end of the lower wall, with a beveled portion which angles downward to the end of the lower wall, so that a wall thickness of the lower wall decreases toward the end.

42. The rectangular floor panel according to claim 41, wherein the beveled section of the joint projection, and the beveled portion of the lower wall of the joint recess, form separate spaces which allow movement of a common joint when the rectangular floor panel and an adjacent panel are joined to form the common joint, and which allow a filler to be inserted that remains flexible after curing.

43. The rectangular floor panel according to claim 41, wherein the joint projection projects from the panel by a distance that is no greater than a thickness of the panel.

44. Method for laying and interlocking rectangular panels provided with a pair of opposite long sides and a pair of opposite short sides, each of which pair of sides displays complementary retaining profiles extending over a length of the sides, the method comprising:

connecting a first new panel with a laid panel in a first row on short sides thereof, either with complementary retaining profiles of the laid panel and the first new panel slid into each other in a longitudinal direction of the panels in a common plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;

thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels;

pivoting the panel laid in the second row upwards, at least at an end thereof, and thereafter laying a third new panel in the second row, by first interlocking the third new panel with the panel of the second row on a short side thereof, such that the third new panel assumes an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels.

45. Method according to claim 44, wherein one retaining profile of a side of a pair of opposite sides is in the form of a joint projection with a convex curvature, and wherein a complementary retaining profile of another side of the pair of opposite sides is in the form of ajoint recess with a concave curvature, and wherein ajoint projection of a new panel is inserted into ajoint recess of a laid panel, expanding it only slightly, and the new panel is finally interlocked by pivoting into the plane of the laid panel.

46. The method according to claim 44, wherein, in the laying of the third new panel in the second row, the pivoting of the panel laid in the second row upwards, at least at an end thereof, causes the panel laid in the second row to twist along its longitudinal axis.

47. Method for laying and interlocking rectangular panels provided with a pair of opposite long sides and a pair of opposite short sides, each of which pair of sides displays complementary retaining profiles extending over a length of the sides, the method comprising:

connecting a first new panel with a laid panel in a first row on short sides thereof, either with complementary retaining profiles of the laid panel and the first new panel slid into each other in a longitudinal direction of the panels in a conmon plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;

thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels; and thereafter laying a third new panel in the second row, by first interlocking the third new panel with the panel of the second row on a short side thereof, and thereafter pivoting the panel laid in the second row upwards, at least at an end thereof, together with the third new panel, into an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels.

48. Method according to claim 47, wherein one retaining profile of a side of a pair of opposite sides is in the form of ajoint projection with a convex curvature, and wherein a complementary retaining profile of another side of the pair of opposite sides is in the form of ajoint recess with a concave curvature, and wherein a joint projection of a new panel is inserted into a joint recess of a laid panel, expanding it only slightly, and the new panel is finally interlocked by pivoting into the plane of the laid panel.

49. The method according to claim 47, wherein, in the laying of the third new panel in the second row, the pivoting of the panel laid in the second row upwards, at least at an end thereof, causes the panel laid in the second row to twist along its longitudinal axis.

* * * * *

US006804926C1

(12) EX PARTE REEXAMINATION CERTIFICATE (6779th)

United States Patent

Eisermann

(10) Number: US 6,804,926 C1

(45) Certificate Issued: *Apr. 21, 2009

(54) METHOD FOR LAYING AND INTERLOCKING PANELS

(75) Inventor: Ralf Eisermann, Cochem (DE)

(73) Assignee: Akzenta Paneele & Profile GmbH, Kaisersesch (DE)

Reexamination Request:
No. 90/008,250, Sep. 28, 2006

Reexamination Certificate for:

| | |
|---|---|
| Patent No.: | **6,804,926** |
| Issued: | **Oct. 19, 2004** |
| Appl. No.: | **09/609,251** |
| Filed: | **Jun. 30, 2000** |

( * ) Notice: This patent is subject to a terminal disclaimer.

Related U.S. Application Data

(63) Continuation of application No. PCT/DE00/00870, filed on Mar. 22, 2000.

(30) Foreign Application Priority Data

Jul. 2, 1999 (DE) ..... 299 11 462 U

(51) Int. Cl.

| | |
|---|---|
| ***B27F 1/00*** | (2006.01) |
| ***B27F 1/04*** | (2006.01) |
| ***E04F 15/04*** | (2006.01) |
| ***E04B 2/00*** | (2006.01) |

(52) U.S. Cl. ..... 52/592.1; 52/592.4

(58) Field of Classification Search ..... None
See application file for complete search history.

(56) References Cited

U.S. PATENT DOCUMENTS

| | | | |
|---|---|---|---|
| 4,426,820 | A | 1/1984 | Terbrack et al. |
| 6,023,907 | A | 2/2000 | Pervan |
| 6,804,926 | B1 | 10/2004 | Eisermann |
| 7,065,935 | B2 | 6/2006 | Ralf |

OTHER PUBLICATIONS

English language translation of Beernaert & Missinne BVBA Printing Shop Receipt dated Mar. 12, 1999.
Ex. 1 to NPL2, Quick Step, "Uniclic System—Laminated flooring," BHK of America, Inc., UN–A 000007–000010.
Ex. 2 to NPL2, Quick Step, "Uniclic System—Laminate flooring," BHK of America, Inc., UN–A 000271–000274.
Ex. 3 to NPL2, Quick Step Majestic, "Uniclic System—Laminate flooring," BHK of America, Inc., UN–A 000023–000026.
Ex. 4 to NPL2, Välinge Aluminum, "Fiboloc Installation Instruction," accessed at http://www.valingealuminum.se, Välinge Aluminum AB, UN–A 000281–000284.
Ex. 1 to NPL7, In the United States District Court for the District of Maryland, *Akzenta* v. *Unilin,* "Complaint for Patent Infringement," Dec. 27, 2005, 9 pages.
Ex. 12 to NPL7, Quick Step, "Uniclic System—Laminate flooring," BHK of America, Inc., UN–A 000271–000274.
Ex. 13 to NPL7, Quick Step, "Uniclic System—Laminate flooring," BHK of America, Inc., UN–A 001869–001874.

(Continued)

*Primary Examiner*—David O. Reip

(57) ABSTRACT

Rectangular floor panels, a fastening system for joining the panels, and a method for laying and interlocking the panels are disclosed. The panels are provided complementary, form-fitting retaining profiles extending over the length of the sides. The complementary edges of the panels allow two adjacent panels to be positively joined such that displacement of the panels away from one another is prevented, while enabling articulation of the panels with respect to one another at the joint location. The method of installation provides for installing a new panel to a first row and a panel in a second row by first joining the new panel to the panel of the second row at its short side, followed by pivoting the new panel upwards out of the plane of the laid panels along its long side, along with at least the adjacent end of the first panel in the second row, into an inclined position, and sliding the new panel into the retaining profile of the panels in the first row. The new panel and the raised end of the panel in the second row are then pivoted down into the plane of the laid panels. Laying of panels continues according to this process until the complete floor assembly has been laid.

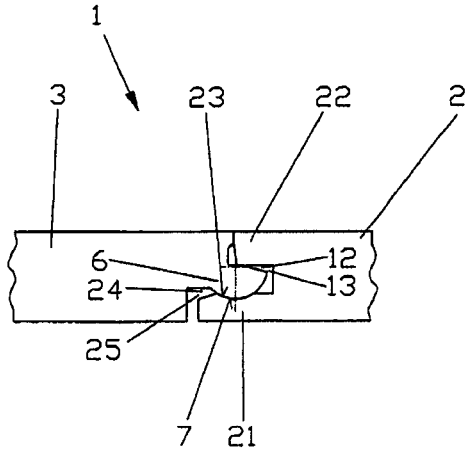

OTHER PUBLICATIONS

Ex. 14 to NPL7, Välinge Aluminum, "Fiboloc Installation Instruction," accessed at http://www.valingealuminum.se, Välinge Aluminum AB, UN–A 000281–000284.

Ex. 2 to NPL25, United States International Trade Commission, *Certain Flooring Products,* "Final Initial Determination," Nov. 2, 2001, 2 pages.

Ex. 3 to NPL25, Cover Letter to United States Patent and Trademark Office for U.S. Appl. No. 09/609,251, filed Jun. 30, 2000, UN–A 000474–000475.

Ex. 6 to NPL25, Columbia Flooring, "Columbia Classic Clic," 6 pages.

Ex. 7 to NPL25, Quick Step, "Uniclic Installation Instructions," UN–A 000001–000006.

Statements under oath of Mr. Herbert Terbrack dated Dec. 23, 2004, and Mr. Wilhelm Mümken dated Jan. 6, 2005, and accompanying photos filed in opposition proceedings again EP 1 026 341 B1 and EP 1 223 267 B1.

Statements under oath of Mr. Herbert Terbrack dated Sep. 3, 2004, and accompanying documents filed in opposition proceedings against EP 0 969 164 B1.

Extract of webpage www.quick–step.com, UNILIN Décor nv, B–8710 Wielsbeke, Belgium. (May 9, 1999).

Pervan, D. Short side angling of Fiboloc and Alloc, T99/install–short–990325. (date unknown).

FIBOLOC Floor Laying Instructions. Norske Skog Flooring. (German Language) (date unknown).

Quick–Step UNICLIC laminated flooring instructions ("the 1998 Unilin Instructions"), BHK of America, Inc., date unknown.

UNICLIC laminated flooring instructions ("the 99050 Unilin Instructions"), date unknown.

Documents allegedly attached to displays in stores selling Fiboloc laminate flooring, and installation instructions allegedly included in some boxes of flooring product ("the Fiboloc Instructions"), Valinge Aluminum AB and Norske Skog Flooring (USA) Inc., dates unknown.

Quick–Step UNICLIC laminated flooring instructions ("the 2000 Unilin Instructions"), BHK of America, Inc., date unknown.

Quick–Step UNICLIC laminated flooring instructions, BHK of America, Inc., date unknown ("the Unilin 1998 Instructions").

Quick–Step UNICLIC laminated flooring instructions, BHK of America, Inc., date unknown ("the Unilin 2000 Instructions").

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 46 and 49 are cancelled.

Claims 44 and 47 are determined to be patentable as amended.

New claims 50–56 are added and determined to be patentable.

Claims 1–43, 45 and 48 were not reexamined.

44. Method for laying and interlocking rectangular panels provided with a pair of opposite long sides and a pair of opposite short sides, each of which pair of sides displays complementary retaining profiles extending over a length of the sides, the method comprising:

connecting a first new panel with a laid panel in a first row on short sides thereof, either with complementary retaining profiles of the laid panel and the first new panel slid into each other in a longitudinal direction of the panels in a common plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;

thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels;

pivoting the panel laid in the second row upwards, [at least] at an end thereof, *wherein the pivoting of the panel laid in the second row upwards at an end thereof causes the panel laid in the second row to twist along its longitudinal axis;* and thereafter laying a third new panel in the second row, by first interlocking the third new panel with the panel of the second row on a short side thereof, such that the third new panel assumes an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels,

*wherein the twisting of the panel laid in the second row along its longitudinal axis is sufficient to allow laying of the third new panel along with the panel of the second row.*

47. Method for laying and interlocking rectangular panels provided with a pair of opposite long sides and a pair of opposite short sides, each of which pair of sides displays complementary retaining profiles extending over a length of the sides, the method comprising:

connecting a first new panel with a laid panel in a first row on short sides thereof, either with complementary retaining profiles of the laid panel and the first new panel slid into each other in a longitudinal direction of the panels in a [conmon] *common* plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;

thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels; and thereafter laying a third new panel in the second row, by first interlocking the third new panel with the panel of the second row on a short side thereof, and thereafter pivoting the panel laid in the second row upwards, [at least] at an end thereof, together with the third new panel, into an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels,

*wherein in the laying of the third new panel in the second row, the pivoting of the panel laid in the second row upwards at an end thereof causes the panel laid in the second row to twist along its longitudinal axis.*

*50. A method for laying and interlocking rectangular panels provided with a pair of opposite long sides and a pair of opposite short sides, each of which pair of sides displays complementary retaining profiles extending over a length of the sides, the method comprising:*

*connecting a first new panel with a laid panel in a first row on short sides thereof, either with complementary retaining profiles of the laid panel and the first new panel slid into each other in a longitudinal direction of the panels in a common plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;*

*thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels;*

*pivoting the panel laid in the second row upwards at an end thereof, thereby causing the panel laid in the sec-*

*ond row to twist along its longitudinal axis such that a portion of the complementary retaining profiles of the pair of opposite long sides of the panel laid in the second row and a panel from first row are interlocked, and a portion of the complementary retaining profiles of the pair of opposite long sides of the panel laid in the second row and a panel from the first row are non-interlocked; and*

*thereafter laying a third new panel in the second row, by first interlocking the third new panel with the panel of the second row on a short side thereof, such that the third new panel assumes an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels.*

*51. A method for laying and interlocking rectangular panels provided with a pair of opposite long sides and a pair of opposite short sides, each of which pair of sides displays complementary retaining profiles extending over a length of the sides, the method comprising:*

*connecting a first new panel with a laid panel is a first row on short sides thereof, either with complementary retaining profiles of the laid panel and the first new panel slid into each other in a longitudinal direction of the panels in a common plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;*

*thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels;*

*twisting the panel laid in the second row such that a proximal short side end of the panel is at a first angle relative to the panel of the first row such that at the proximal short side end a portion of the complementary retaining profiles of the pair of opposite long sides of the panel laid in the second row and a panel from the first row are non-interlocked and such that a distal short side end of the panel is at a second angle relative to the panel of the first row such that at the distal short side end a portion of the complementary retaining profiles of the pair of opposite long sides of the panel laid in the second row and a panel from the first row are interlocked; and*

*thereafter laying a third new panel in the second row, by first interlocking the third new panel with the panel of the second row on a short side thereof, such that the third new panel assumes an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels.*

*52. The method of claim 51, wherein the step of twisting the panel laid in the second row comprises applying a force in addition to the force of gravity acting on the panel laid in the second row.*

*53. A method for laying and interlocking rectangular panels provided with a pair of opposite long sides and a pair of opposite short sides, each of which pair of sides displays complementary retaining profiles extending over a length of the sides, the method comprising:*

*connecting a first new panel with a laid panel in a first row on short sides thereof, either with complementary retaining profiles of the laid panel and the first new panel slid into each other in a longitudinal direction of the panels in a common plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;*

*thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels; and*

*thereafter laying a third new panel in the second row, by first interlocking the third new panel with the panel of the second row on a short side thereof, and thereafter pivoting the panel laid in the second row upwards, at an end thereof, together with the third new panel, into an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels*

*wherein in the laying of the third new panel in the second row, the pivoting of the panel laid in the second row upwards at an end thereof causes the panel laid in the second row to twist along its longitudinal axis such that a portion of the complementary retaining profiles of the pair of opposite long sides of the panel laid in the second row and a panel from the first row are interlocked, and a portion of the complementary retaining profiles of the pair of opposite long sides of the panel laid in the second row and a panel from the first row are non-interlocked.*

*54. A method for laying and interlocking rectangular panels provided with a pair of opposite long sides and a pair of opposite short sides, each of which pair of sides displays complementary retaining profiles extending over a length of the sides, the method comprising:*

*connecting a first new panel with a laid panel in a first row on short sides thereof, either with complementary retaining profiles of the laid panel and the first new panel slid into each other in a longitudinal direction of the panels in a common plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;*

*thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels; and*

*thereafter laying a third new panel in the second row, by first interlocking the third new panel with the panel of the second row on a short side thereof, and thereafter applying a twisting force to the panel laid in the second row such that the panel laid in the second row is pivoted into an inclined position in which the retaininig profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels,*

*wherein in the laying of the third new panel in the second row, the applying of the twisting force to the panel laid in the second row causes the panel laid in the second row to twist along its longitudinal axis such that a portion of the complementary retaining profiles of the pair of opposite long sides of the panel laid in the second row and a panel from the first row are interlocked, and a portion of the complementary retaining profiles of the pair of opposite long sides of the panel laid in the second row and a panel from the first row are non-interlocked.*

*55. A method for laying and interlocking rectangular panels provided with a pair of opposite long sides and a pair of opposite short sides, each of which pair of sides displays complementary retaining profiles extending over a length of the sides, the method comprising:*

*connecting a first new panel with a laid panel in a first row on short sides thereof, either with complementary retaining profiles of the laid panel and the first new panel slid into each other in a longitudinal direction of the panels in a common plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;*

*thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels;*

*pivoting the panel laid in the second row upwards, at an end thereof, wherein the pivoting of the panel laid in the second row upwards at an end thereof causes the panel laid in the second row to twist along its longitudinal axis; and*

*thereafter laying a third new panel in the second row, by first interlocking the third new panel with the panel of the second row on a short side thereof, such that the third new panel assumes an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels,*

*wherein one retaining profile of a side of a pair of opposite sides is in the form of a joint projection with a convex curvature, and wherein a complementary retaining profile of another side of the pair of opposite sides is in the form of a joint recess with a concave curvature, and wherein a joint projection of a new panel is inserted into a joint recess of a laid panel, expanding it only slightly, and the new panel is finally interlocked by pivoting into the plane of the laid panel.*

*56. A method for laying and interlocking rectangular panels provided with a pair of opposite long sides and a pair of opposite short sides, each of which pair of sides displays complementary retaining profiles extending over a length of the sides, the method comprising:*

*connecting a first new panel with a laid panel in a first row on short sides thereof, either with complementary retaining profiles of the laid panel and the first new panel slid into each other in a longitudinal direction of the panels in a common plane, or with the retaining profile of the first new panel initially inserted in an inclined position relative to the laid panel having a complementary retaining profile of the laid panel, and subsequently interlocked, both in a direction perpendicular to the connected ends and in a direction perpendicular to the plane of the laid panels, by pivoting the first new panel into the plane of the laid panel;*

*thereafter laying a second new panel in the second row by inserting the retaining profile of the long side of the second new panel into the retaining profile of a long side of a panel of the first row by positioning at an angle relative to the panel of the first row and subsequently pivoting the second new panel into the plane of the laid panels; and*

*thereafter laying a third new panel in the second row, by first interlocking the third new panel with the panel of the second row on a short side thereof, and thereafter applying a twisting force to the panel laid in the second row, at an end thereof, together with the third new panel, such that the panel laid in the second row is pivoted into an inclined position in which the retaining profile of the long side of the third new panel can be inserted into the complementary retaining profile of the panel or panels laid in the first row and, after insertion, the inclined third new panel and the panel laid in the second row interlocked with the third new panel are pivoted into the plane of the laid panels,*

*wherein the laying of the third new panel in the second row, the applying of the twisting force to the panel laid in the second row at an end thereof causes the panel laid in the second row to twist along its longitudinal axis such that a portion of the complementary retaining profiles of the pair of opposite long sides of the panel laid in the second row and a panel from the first row are interlocked, and a portion of the complementary retaining profiles of the pair of opposite long sides of the panel laid in the second row and a panel from the first row are non-interlocked.*

* * * * *